United States Patent [19]

Seymour

[11] Patent Number: 5,049,160

[45] Date of Patent: Sep. 17, 1991

[54] TAXIDERMIC CLEANING COMPOUND AND METHOD

[76] Inventor: Michael J. Seymour, 6728 Maryellen St., Normandy, Mo. 63121

[21] Appl. No.: 381,987

[22] Filed: Jul. 19, 1989

[51] Int. Cl.[5] ..... D06L 3/00

[52] U.S. Cl. ..... 8/137; 8/127.51; 252/8.57

[58] Field of Search ..... 8/137, 127.51; 252/8.57

[56] References Cited

U.S. PATENT DOCUMENTS 3,953,350 4/1976 Fujino et al. ..... 252/94

FOREIGN PATENT DOCUMENTS 62-48372 3/1987 Japan .
63-199796 8/1988 Japan .

*Primary Examiner*—Prince E. Willis
*Assistant Examiner*—John F. McNally
*Attorney, Agent, or Firm*—Polster, Polster and Lucchesi

[57] ABSTRACT

Cleaning compound for cleaning the hair and fur of mounted animals comprises about fifty percent by weight of a dry form sodium carbonate peroxyhydrate, forty percent by weight dry sodium carbonate, and ten percent by weight of dry surfactant, preferably sodium dodecylbenzenesulfonate. The compound is dissolved in water, and sprayed on the hair or fur of mounted animals.

1 Claim, No Drawings

TAXIDERMIC CLEANING COMPOUND AND METHOD

BACKGROUND OF THE INVENTION

The hair and fur of mounted animals become soiled over time. They absorb or become coated with airborne pollutants, become yellow by the action of bacteria and are likely to be infested with insects such as carpet beetle larvae. They often have suffered smoke or fire damage too. In any event, it is highly desirable to clean the hair and fur to restore them as nearly as possible to their original color and luster, but without damaging either the hair and fur or the hide to which they are attached.

Various detergents have been tried in the past, but those known heretofore have either been ineffective to remove the yellow stain, even if they clean off dirt, or turn the hair red or injure the hair and hide. Hydrogen peroxides have been used, but they are difficult to control, and liable to bleach the hair and fur unnaturally and to injure the hair, fur and hide.

One of the objects of this invention is to provide a cleaning composition that is easily compounded, has a long shelf life, is easy to prepare and use, is effective to remove yellow staining as well as dirt, plaque, and bacteria, and is safe to use and harmless to hair, fur and hide.

Another object of this invention is to provide a method of using the compound to achieve the desired results.

Other objects of this invention will be apparent to those skilled in the art in light of the following description.

SUMMARY OF THE INVENTION

In accordance with this invention, generally stated, a cleaning compound for cleaning the hair and fur of mounted animals is provided which comprises dry form sodium carbonate peroxyhydrate, sodium carbonate, and a dry surfactant, preferably dodecyl sulfonate. The compound can be stored in sealed containers substantially indefinitely. When it is to be used, it is dissolved in water in the proportion of the order of one quarter teaspoon compound and four ounces of water. It is preferably sprayed onto the hair or fur of a mounted animal, without soaking the hide of the animal, and wiped off. The process can be repeated until the hair and fur are clean and their color restored. It is desirable not to soak the hide, although if done carefully, the solution can be toweled on. The problem of having the hide split on drying is not peculiar to the use of the compound of this invention.

DESCRIPTION OF THE PREFERRED EMBODIMENT

An eminently satisfactory cleaning compound of this invention is made up by weight of fifty percent percarbonate (sodium carbonate peroxyhydrate, $2Na_2CO\ 3H_2O_2$) in the form of an anhydrous powder: forty percent sodium carbonate ($Na_2CO_3$) in dry granular form, and ten percent dry sodium dodecylbenzenesulfonate ($C_{12}H_{25}C_6H_4SO_3Na$). The three ingredients are mixed well and placed in a container that can be made airtight by any suitable closure.

In order(to use the compound for cleaning, it is dissolved in water in the proportion of approximately one quarter teaspoon for four ounces of water, put into a small atomizer and sprayed onto the hair or fur to be cleaned. It is permitted to remain on the hair for a few minutes and then wiped off with a clean cloth of toweling. The process of spraYing and wiping is repeated until the fur or hair is clean and its color restored.

It has been found that the cleaning compound of this invention, unlike any other cleaning compounds known to applicant, is effective to remove the yellow stain from fur and hair, as well as cleaning the fur and hair of dirt, smoke and other pollutants that have accumulated on the fur and hair in the course of time.

The proportions of the ingredients can be varied. However, the use of sixty percent or more of the percarbonate will result in the removal of some color from the hair, and the use of less than forty percent is markedly less effective in removing the yellow. It is also undesirable to use substantially more than forty percent sodium carbonate.

Other surfactants have been found to give poor results or even to harm the hair or fur. Ammonium compounds tend to bleach out the blacks in the hair or fur to a rusty brown. Sodium tripolyphosphate, metasilicates, trisodium phosphate, and sodium sesquicarbonates have been found to give poor results.

The particular compound of this invention produces a synergistic effect in the cleaning of hair and fur, which has not been observed in compounds known heretofore.

The use of a greater amount of the dry compound in the solution does not harm the hair, fur or hide to which the solution containing a greater concentration of the compound is applied, but it is unnecessary to accomplish the purpose. It has been found that the composition of this invention is also useful in the removal of blood and other stains from fibers other than fur and hair.

Having thus described the invention, what is claimed and desired to be secured by Letters Patent is:

1. The process of cleaning hair or fur of a mounted animal comprising the steps of a) spraying on said hair or fur an aqueous solution consisting of about 50 weight percent carbonate peroxyhydrate, about 40 weight percent sodium carbonate, and about 10 weight percent dodecylbenzenesulfonate wherein said percentage is based on the dry weight of the composition before dissolution and wherein the proportion of said compound is one fourth teaspoon to four ounces of water;

b) maintaining said solution in contact with said hair or fur for a few minutes; and c) removing said solution from said hair or fur.

* * * * *